United States Patent [19]

Kittel

[11] Patent Number: 4,813,796

[45] Date of Patent: Mar. 21, 1989

[54] RIBBON CASSETTE HAVING LINE FORMING MEANS FOR TYPEWRITERS OR OFFICE MACHINES OF SIMILAR CONSTRUCTION

[75] Inventor: Arthur Kittel, Wilhelmshaven, Fed. Rep. of Germany

[73] Assignee: AEG Olympia Aktiengesellschaft, Wihelmshaven, Fed. Rep. of Germany

[21] Appl. No.: 60,468

[22] Filed: Jun. 11, 1987

[30] Foreign Application Priority Data

Jun. 11, 1986 [DE] Fed. Rep. of Germany ..... 3619567
Oct. 14, 1986 [DE] Fed. Rep. of Germany ..... 3634918

[51] Int. Cl.[4] ..... B41J 29/28; B41J 32/00

[52] U.S. Cl. ..... 400/18; 400/208; 400/21

[58] Field of Search ..... 400/16, 17, 18, 19, 400/20, 21, 22, 194, 195, 196, 196.1, 207, 208, 208.1

[56] References Cited

U.S. PATENT DOCUMENTS

| | | | |
|---|---|---|---|
| 2,490,600 | 12/1949 | Perez | 400/18 |
| 2,581,167 | 1/1952 | Bosauet | 400/18 |
| 2,711,810 | 6/1955 | Greenspan | 400/18 |
| 4,259,025 | 3/1981 | Jamieson | 400/18 |
| 4,644,367 | 2/1987 | Onoda et al. | 400/18 X |

FOREIGN PATENT DOCUMENTS

| | | | |
|---|---|---|---|
| 891271 | 9/1953 | Fed. Rep. of Germany | 400/18 |
| 3440690 | 5/1985 | Fed. Rep. of Germany . | |
| 3411364 | 10/1985 | Fed. Rep. of Germany . | |
| 0104979 | 6/1984 | Japan | 400/22 |
| 0114074 | 6/1984 | Japan | 400/208 |
| 0212354 | 10/1985 | Japan | 400/18 |
| 0259478 | 12/1985 | Japan | 400/21 |

*Primary Examiner*—Ernest T. Wright, Jr.
*Attorney, Agent, or Firm*—Spencer & Frank

[57] ABSTRACT

Several line drawing devices to permit drawing horizontal and vertical lines on typewriters are known. The fact that they are rarely encountered in practice, should be sufficient proof that they were not found to be satisfactory and greatly impede the typing process. These drawbacks are overcome by the invention in that the ribbon cassette is provided with a receptacle for a colored writing implement which, in one end position, resiliently rests on the record carrier so as to produce drawn lines and is arranged to be movable and arrestable in another end position to put it out of operation. A significant advantage resides in the fact that the colored writing implement can here be attached to the cassette at a location where the typing process is not interfered with. The colored writing implement can easily be exchanged by removing the ribbon cassette. The ribbon cassette together with the colored writing implement permits easy production of drawn lines in the horizontal, vertical or any other direction. Exchange of the colored writing implement can be effected without any particular skill on the part of the operator.

20 Claims, 2 Drawing Sheets

RIBBON CASSETTE HAVING LINE FORMING MEANS FOR TYPEWRITERS OR OFFICE MACHINES OF SIMILAR CONSTRUCTION

BACKGROUND OF THE INVENTION

1. Field of the Invention

The invention relates to a ribbon cassette for typewriters or office machines having a receptacle on the carriage and a transport device for a printer ribbon which can be brought out of an exit opening in the cassette housing and pulled back again into an entrance opening of the cassette housing.

2. Discussion of the Prior Art

Several line-drawing devices for drawing horizontal and vertical lines on typewriters are known. The fact that they are rarely encountered in practice should be sufficient proof that they have not been found satisfactory or are too great an impediment for the typing process.

German Pat. No. 891,271 discloses a holding device at typewriters to accommodate a threaded ball-point writing implement cartridge in which a threaded holder for the writing cartridge is disposed on the card holder to the right or left of the type face guiding head and is fixed thereto by means of a clamp. The plastic card holder has a threaded sleeve to receive the writing cartridge instead of an insertion hole. Such an arrangement interferes with the typing process, particularly in machines in which the print head is disposed on a carriage which moves along the record carrier. Exchange of the ball-point pen cartridges would also require a certain amount of skill on the part of the machine operator.

SUMMARY OF THE INVENTION

It is the object of the invention to improve the above-mentioned prior art in that lines can be drawn in the simplest manner in a horizontal, vertical or other direction. The above and other objects are accomplished by the invention in which a ribbon cassette for typewriters or office machines of similar construction having a receptacle on a carriage movable along a record carrier comprises: a cassette housing; a transport device for a printer ribbon; the cassette having an entrance opening and an exit opening in the cassette housing, wherein the improvement comprises: means forming a receptacle for at least one colored writing implement, the means including a first position and a second position, so that in the first position the colored writing implement can be brought into resilient engagement with the record carrier so as to produce drawn lines and when in the second position the colored writing implement is placed out of engagement with the record carrier.

The ribbon cassette is provided with a displacement element including a colored writing implement, with this displacement element being movable by means of a handle attached thereto from an out-of-engagement position into a ready position. The colored writing implement may be attached to the cassette at a point where it does not interfere with the typing process. Moreover, the colored writing implement can easily be exchanged, for example by removing the ribbon cassette. Also, if the cassette is exchanged because the ribbon is spent, the colored writing implement can be removed from this cassette and inserted into a new cassette. The ribbon cassette equipped with the colored writing implement permits easy generation of drawn lines in the horizontal, vertical or any other direction.

The ribbon cassette with the displaceable colored writing implement can be modified in such a manner that the colored writing implement can be switched in and out by means of a keyboard signal or in on-line operation by means of software. This is advantageously accomplished in that placing the ribbon cassette onto its receptacle on the carriage, which moves along the record carrier, causes the displaceable holders for the colored writing implements to be automatically coupled with electrically actuated drive members in the receptacle. The writing implements are brought into the operating position by means of electromagnets which are in operative connection with the drive members in response to a keyboard signal or in on-line operation by means of software and, once the electromagnets have been excited, the writing implements are returned to their starting positions by means of spring force.

Other advantageous features of the invention are defined in the remaining dependent claims.

BRIEF DESCRIPTION OF THE DRAWINGS

The invention will be described in greater detail below with reference the Figures in which.

DESCRIPTION OF THE PREFERRED EMBODIMENTS

Figure 1:
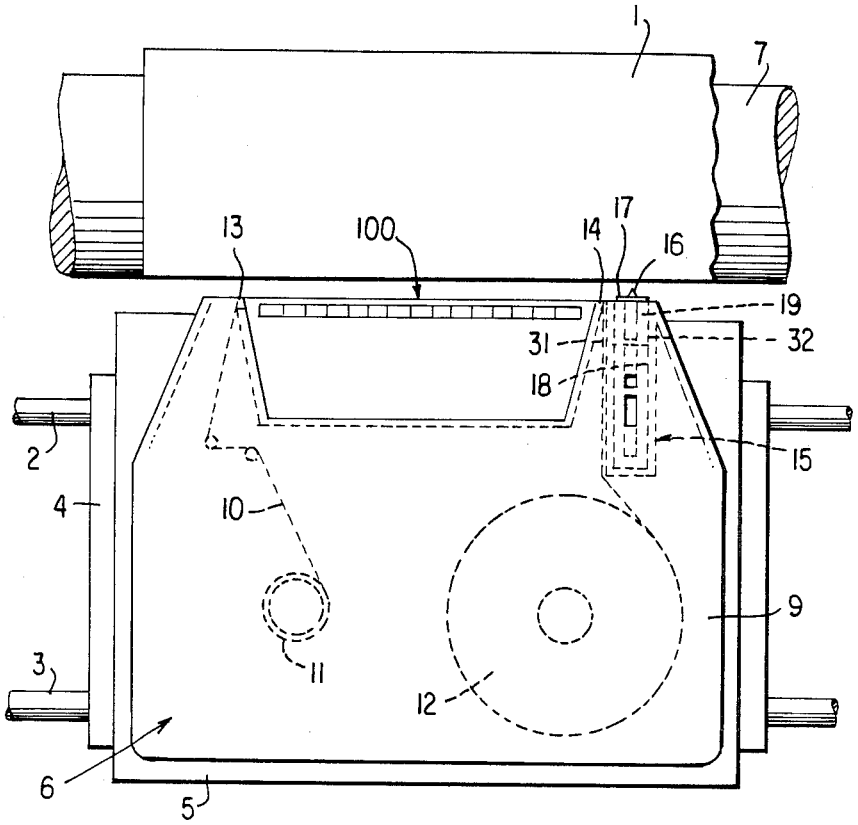
FIG. 1 is a top view of a ribbon cassette in the receptacle of the machine.

FIG. 1 shows a carriage 4 which is movable on shafts 2, 3 along a record carrier 1 and is equipped with a receptacle 5 for the ribbon cassette 6. Record carrier 1 is transported in a known manner by a platen 7. The ribbon cassette housing for ribbon cassette 6 is composed of a cup-shaped bottom member 8 and a planar cover 9. Ribbon 10 is unwound from a supply reel 11 by means of a transporting device, is brought through an exit opening 13 to the printing station 100 and is then guided through an entrance opening 14 to a wind-up reel 12. Ribbon cassette 6 includes a receptacle 15 for a colored writing implement 16 which may be, for example, a felt-tip or ball-point writing implement cartridge and, in an end position on record carrier 1, lies resiliently against record carrier 1 so as to produce lines in a vertical, horizontal or other direction and can be moved into another end position and latched there to put it out of operation. Colored writing implement 16 is fastened to be exchangeable in a holder 17 which can be inserted into a receiving opening 18 in the cassette housing 8, 9 and is arranged therein so as to be displaceable into the two end positions.

Figure 2:
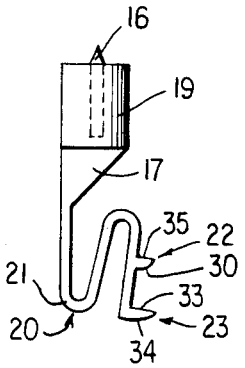
FIG. 2 is a sectional view of a holder with the colored writing implement.

FIG. 2 shows the holder 17 with the colored writing implement 16 before insertion into receiving opening 18 of the cassette housing 8, 9. This holder 17 is composed of an injection-molded plastic member which is provided with the colored writing implement 16 at its end 19 projecting from the cassette housing 8, 9 and at its other end 20 with a switching arm 21 which can be inserted into receiving opening 18. This switching arm 21 is configured as a molded spring which is resilient perpendicularly to the displacement direction of holder 17 and is provided with detent lugs 22, 23 which engage into detent recesses 24, 25 for the two end positions provided on the upper side 26 of the cassette housing 8, 9. Detent recesses 24, 25 are preferably disposed in the planar cover 9 of the cassette housing 8, 9, with cover 9 simultaneously forming a wall of receiving opening 18.

Moreover, detent lug 23 is configured as a push handle so that holder 17 can be moved from the one into the other end position by the force of a finger. During movement of holder 17 into the two end positions, detent lug 23 is guided within detent recess 25 which serves as a sliding slot. In the ready position of colored writing implement 16, the straight edge 33 of detent lug 23 rests resiliently against end edge 28 and, in the other end position, its rounded edge 34 rests against the other end edge 29 of detent recess 25. In the out-of-operation position of colored writing implement 16, the straight edge 35 of the second detent lug 22 is pushed against end edge 28 of detent recess 25.

The underside of second detent lug 22 is provided with a sloped face extending as a shaped edge 30 by way of which holder 17 together with colored writing implement 16 is resiliently pressed against record carrier 1 when the second detent lug 22 engages in detent recess 24. In the simplest possible way, this produces a spring force in the direction in which holder 17 is pushed against record carrier 1. Moreover, the end 19 of holder 17 which supports colored writing implement 16 is configured as a guide member equipped with guide faces 31, 32. These guide faces 31, 32 are mounted so as to be displaceable in receiving opening 18.

Figure 3:
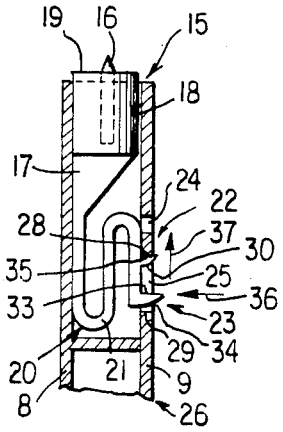
FIG. 3 is a detailed sectional view of FIG. 1, with the holder for the colored writing implement being disposed in the out-of-engagement position.

FIG. 3 shows holder 17 in the out-of-engagement position. If holder 17 is now to be brought into the ready position, the force of a finger initially charges detent lug 23 in the direction of arrow 36 in such a manner that detent lug 22 goes out of engagement with the end edge 28 of detent recess 25. After this unlatching, the force of a finger moves detent lug 23 upward in the direction of arrow 37 until lug 22 engages in detent recess 24. During this engagement, a sloped face 30 serving as a shaped edge generates a uniform, resilient pressure force which presses colored writing implement 16 against record carrier 1, thus always permitting the drawing of uniform lines.

Figure 4:
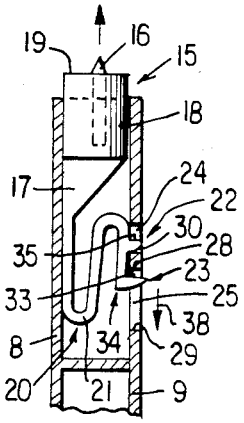
FIG. 4 shows the holder of FIG. 3 in the operating position.

Setting holder 17 back from the ready position of FIG. 4 into the out-of-engagement position of FIG. 3 is effected in that detent lug 23 is initially displaced again in detent recess 25 in the direction of arrow 36 and then downward in the direction of arrow 38 to the extent that detent lug 22 also engages in detent recess 25. Then, the straight edge 35 of detent lug 22 again lies against the end edge 28 in detent recess 25.

Figure 5:
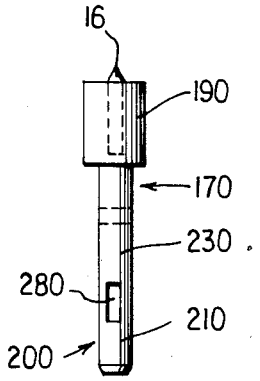
FIG. 5 shows a sectional view of a further embodiment of the holder for the colored writing implement.
Figure 6:
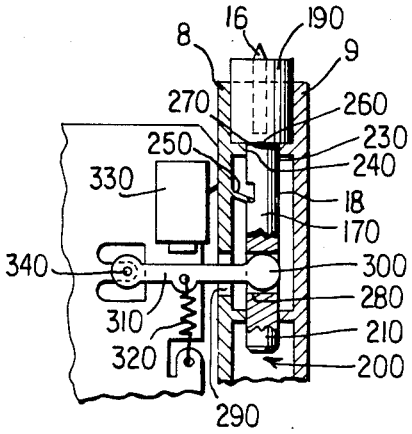
FIG. 6 shows a detailed sectional view of the further embodiment of the mechanism for moving the colored writing implement.

FIG. 5 shows holder 170 with colored writing implement 16 before it is inserted into receiving opening 18 in the cassette housing 8, 9. This holder 170 is composed of an injection molded plastic member which, at its end 190 projecting from the cassette housing 8, 9, is provided with the colored writing implement 16 and at its other end 200 with a bearing member 210 which can be inserted into receiving opening 18. The cylindrical bearing member 210 of holder 170 is mounted in a rear bearing bore 220 and a bearing pin 230 of holder 170 is mounted in a front bearing bore 240 so as to be displaceable in receiving opening 18. Moreover, a projecting spring arm 250 attached by injection molding is disposed in receiving opening 18. It is provided to hold holder 170 by its collar 260 at a bearing block 270 provided with a bearing bore 240 so that it is in resilient contact in the starting position. Holder 170 is provided with a coupling member which, when ribbon cassette 6 is placed onto receptacle 5 of carriage 4, can be coupled to the drive member mounted thereon. For this purpose, displaceable holder 170 is provided with a coupling slit 280 so as to form-lockingly couple it to drive member coupling arm 300 which can be pushed through an opening 290 in the bottom 8 of cassette 6. This coupling arm 300 is disposed at the free end of drive lever 310 with which the drive member can bring the colored writing implement 16 into engagement with record carrier 1 in the one end position and return it to its starting position by means of a reset spring 320. Drive lever 310 is configured, for example, as an armature for electromagnet 330 and, if this electromagnet 330 is excited, lever 310 is pivoted counterclockwise around bearing arm 340 against the force of reset spring 320. This creates a simple way to drive the displacement of holder 170 with colored writing implement 16, and coupling and decoupling occur automatically together with placing or removing the ribbon cassette 6 onto or from receptacle 5. Since the drive member also remains in the machine, the ribbon cassettes 6 and the colored writing implements 16 become only insignificantly more expensive than normal ribbon cassettes. When the ribbon cassette 6 is spent, the colored writing implements 16 can easily be transferred to a new cassette 6. It is also possible to have more than one receiving opening 18 in the cassette housing 8, 9 for receiving respective writing implements.

To produce lines or line-shaped curves, holder 170 and the desired colored writing implement 16 is brought into the operating position by means of electromagnet 330 disposed in the printing mechanism in conjunction with a keyboard signal or, in on-line operation, by means of software. The attraction force of this electromagnet 330, in conjunction with spring arm 250, is of such design that an easily visible line can be drawn on record carrier 1. Upon de-excitation of electromagnet 330, drive lever 310 which is configured as an armature, and thus holder 170, are set back into their starting positions by the resetting forces of springs 250 and 320. This brings colored writing implement 16 out of engagement again with record carrier 1.

What is claimed is:

1. In a ribbon cassette for a typewriter or office machine of similar construction having a first receptacle on a carriage movable along a record carrier, the cassette being placeable onto and easily removable from the first receptable and including a cassette housing containing a ribbon and having a ribbon exit opening and a ribbon entrance opening with a portion of the ribbon being disposed outside of the housing and extending between the exit opening and the entrance opening, the improvement wherein said cassette further comprises: means defining a second receptacle carrying a colored writing implement and operable for displacing said implement between a first position in which said colored writing implement can be brought into resilient engagement with the record carrier so as to produce drawn lines, and a second position in which said colored writing implement is placed out of engagement with the record carrier.

2. A ribbon cassette as defined in claim 1, further comprising a holder removably disposed in said means defining a second receptacle, said writing implement being disposed in said holder, said holder including coupling means for coupling said holder to a drive member mounted on the carriage when said cassette is placed into the first receptacle on the carriage.

3. A ribbon cassette as defined in claim 1, further comprising a displaceable holder removably disposed in said means defining a second receptacle, said writing implement being disposed in said holder; said cassette housing having a top side, a bottom side and said bottom side having an opening therein; said displacable holder having a coupling slit, said ribbon cassette being in combination with a drive member having a coupling arm and a reset spring, said coupling arm of said drive member being coupled to said displaceable holder via said coupling slit, said coupling arm being inserted through said opening in said bottom side of said cassette housing; said drive member being connected to said reset spring for returning said colored writing implement to said second position.

4. The combination defined in claim 3, further comprising an electromagnet, wherein said coupling arm of said drive member engaging in said coupling slit of said holder is configured as an armature which is charged by said electromagnet.

5. A ribbon cassette as defined in claim 1, said means defining said second receptacle further comprises a wall having a receiving opening; said cassette further comprising a holder and means for locking said holder in said cassette housing; said colored writing implement being connected to said holder and said holder being insertable and displaceable in said receiving opening in said cassette housing.

6. A ribbon cassette as defined in claim 5, wherein said colored writing implement is removable from said holder.

7. A ribbon cassette as defined in claim 5, wherein said wall having said receiving opening includes a stop and said cassette housing includes spring means for pressing said holder against said stop.

8. A ribbon cassette as defined in claim 7, wherein said spring means includes an injection-molded spring arm made of once piece with said cassette housing which projects into said receiving opening.

9. A ribbon cassette as defined in claim 5, said holder being made of an injection-molded plastic member and said holder having a first end, a second end and a longitudinal direction extending between the first and second ends, said first end includes a recess for receiving said colored writing implement and said second end includes a switching arm which projects into said receiving opening; said switching arm includes detent lugs and said switching arm being provided as a molded spring which is resilient perpendicular to said longitudinal direction of said holder; said cassette housing further comprising a first side and a second side and at least one of said sides having detent recesses; said detent lugs being positioned for engagement with said detent recesses.

10. A ribbon cassette as defined in claim 9, wherein said second side of said cassette housing comprises a cup-shaped bottom member and said first side of said cassette housing comprises a cover, said detent recesses being disposed in said cover and said cover forming said wall of said receiving opening.

11. A ribbon cassette as defined in claim 9, wherein said detent lugs comprise a first detent lug and a second detent lug, said first detent lug being configured as a push handle and said second detent lug having a sloped face; said at least one of said sides having said detent recesses comprises a first detent recess and a second detent recess, wherein said first detent lug is normally positioned in said first detent recess which serves as a push slit, whereby when said second detent lug is engaged in said second detent recess said colored writing implement can be pressed against the record carrier.

12. A ribbon cassette for a typewriter or office machine of similar construction comprising:

a housing having a front surface containing a ribbon entrance opening and a ribbon exit opening;

a ribbon disposed inside said housing with a portion of said ribbon being disposed outside of said housing and extending between the exit opening and the entrance opening; and means defining a receptacle, which is open at said front surface, for carrying a writing implement which can be placed into a first extended position in which the writing implement can be brought into resilient engagement with a record carrier when the cassette is placed in an office machine and a second retracted position in which the writing implement is placed out of engagement with the record carrier, said receptacle defining means being located in a portion of said front surface between one of said openings and a respective lateral edge of said cassette housing.

13. A ribbon cassette as defined in claim 12, further comprising:

a writing implement removably disposed in said receptacle defining means and movable between the first and second positions.

14. A ribbon cassette as defined in claim 13, further comprising:

a displaceable holder removably disposed in said receptacle defining means, said writing implement being disposed in said holder; and means for positioning said holder and said writing implement within said receptacle.

15. A ribbon cassette as defined in claim 14, wherein: said cassette housing has a top side and a bottom side with said bottom side having an opening therein; said receptacle defining means includes a portion of said top side and a portion of said bottom side containing said opening, said displaceable holder has a first portion with an end containing said writing implement which is substantially the same size as the receptacle and a second portion with a smaller size than said first portion and with a coupling slit disposed therein and facing said opening in said bottom side; a stop for said first portion of said displaceable holder is disposed in the receptacle; and said positioning means includes:

a projecting spring arm extending from said receptacle defining means into the receptacle so that said spring arm contacts said second portion of said holder and normally biases said first portion of said holder against said stop to position said holder in the second retracted position.

16. A ribbon cassette as defined in claim 15 in combination with an office machine on which said cassette is mounted and containing means for engaging said coupling slit of said holder via said opening in said bottom side for selectively moving said holder between said first extended and second retracted positions.

17. The combination as defined in claim 16, wherein said means for selectively moving includes: a lever pivotally mounted on the office machine and having a drive arm and a coupling arm, with said coupling arm being inserted through said opening in said bottom side of said cassette housing and being coupled to said displaceable holder via said coupling slit; means for pivoting siad lever to cause said coupling arm to move said holder to said first position; and a reset spring connected to said drive arm for returning said writing implement to the second retracted position.

18. The combination defined in claim 17, wherein said means for pivoting comprises an electromagnet, and wherein said coupling arm engaging in said coupling slit of said holder is configured as an armature which is charged by said electromagnet.

19. A ribbon cassette as defined in claim 14, wherein: said cassette housing further comprises a top side and a bottom side; said means defining a receptacle includes a portion of each of said top and bottom sides; said holder is an injection-molded plastic member having a first end, a second end and a longitudinal direction extending between the first and second ends, with said first end including a recess for receiving said writing implement and said second end includes a switching arm which projects into the receptacle; and said means for positioning includes detent lugs formed on said switching arm which is provided as a molded spring which is resilient perpendicular to said longitudinal direction of said holder, and detent recesses formed in said portion of said top side and positioned for engagement with said detent lugs.

20. A ribbon cassette as defined in claim 19, wherein: said detent lugs comprise a first detent lug and a second detent lug, with said first detent lug being configured as a push handle and said second detent lug having a sloped face; said detent recesses comprise a first detent recess and a second detent recess which are displaced in said longitudinal direction, and said first detent lug is normally positioned in said first detent recess which serves as a push slit, whereby when said second detent lug is engaged in said second detent recess said writing implement is positioned in said first extended position.

* * * * *